US007267371B2

(12) United States Patent
Westrick

(10) Patent No.: US 7,267,371 B2
(45) Date of Patent: Sep. 11, 2007

(54) WRITTEN CORRESPONDENCE KIT

(76) Inventor: Paul Westrick, 772 N. High St., Suite 205, Columbus, OH (US) 43215

( * ) Notice: Subject to any disclaimer, the term of this patent is extended or adjusted under 35 U.S.C. 154(b) by 504 days.

(21) Appl. No.: 10/306,668

(22) Filed: Nov. 27, 2002

(65) Prior Publication Data

US 2004/0100089 A1 May 27, 2004

(51) Int. Cl.
*B42D 15/00* (2006.01)

(52) U.S. Cl. ..... 283/67; 283/117; 206/575

(58) Field of Classification Search ..... 229/68.1, 229/92; 40/702, 751, 752; 206/223, 575, 206/576, 578, 579; 283/67, 116, 117, 56
See application file for complete search history.

(56) References Cited

U.S. PATENT DOCUMENTS

| | | | | | |
|---|---|---|---|---|---|
| 312,756 | A | * | 2/1885 | Peck | 206/215 |
| 3,595,382 | A | * | 7/1971 | Hofer | 206/215 |
| 3,810,324 | A | * | 5/1974 | Hart | 40/777 |
| 3,894,755 | A | * | 7/1975 | Cieslak et al. | 283/116 |
| 3,939,588 | A | * | 2/1976 | Hockaday | 40/1.5 |
| 4,613,157 | A | * | 9/1986 | Drabish | 283/117 |
| 4,807,744 | A | * | 2/1989 | Chiou | 206/214 |
| 4,887,717 | A | * | 12/1989 | Secrest, Jr. | 206/575 |
| 5,219,184 | A | * | 6/1993 | Wolf | 283/56 |
| 5,387,108 | A | * | 2/1995 | Crowell | 434/319 |
| 5,457,904 | A | * | 10/1995 | Colvin | 40/119 |
| 5,577,918 | A | * | 11/1996 | Crowell | 434/319 |
| 5,712,005 | A | * | 1/1998 | Monn | 428/34.1 |
| 5,884,770 | A | * | 3/1999 | Galm | 206/575 |
| 5,887,905 | A | * | 3/1999 | Collins | 283/81 |
| 5,954,369 | A | * | 9/1999 | Seabrook | 283/117 |
| 6,138,832 | A | * | 10/2000 | Hunter et al. | 206/575 |
| 6,257,621 | B1 | * | 7/2001 | Smith | 281/15.1 |
| 6,470,608 | B1 | * | 10/2002 | Edwards | 40/124 |
| 2001/0047945 | A1 | * | 12/2001 | Scherer | 206/38 |
| 2002/0128081 | A1 | * | 9/2002 | Clarke et al. | 472/81 |

FOREIGN PATENT DOCUMENTS

| | | | |
|---|---|---|---|
| AU | WO99/34985 | * | 7/1999 |
| GB | 2113610 A | * | 8/1983 |
| GB | 2260293 | * | 4/1993 |

* cited by examiner

*Primary Examiner*—Dana Ross
(74) *Attorney, Agent, or Firm*—Lathrop & Gage, LC

(57) ABSTRACT

A correspondence kit and method for continued and repeated mailing or sharing or exchanging of a journal between two or more participants. The kit includes a journal of blank writing pages, multiple mailing envelopes, a primary sending envelope and accessories such as photo corners, stickers and labels. One participant will write in the book, add mementos, photographs and similar items. The book will be mailed, with return envelopes to another participant, who will add to the book, and return it to the original sender, or to another participant. The journal is exchanged between the participants until it is complete.

2 Claims, 4 Drawing Sheets

WRITTEN CORRESPONDENCE KIT

BACKGROUND OF THE INVENTION

1. Field of the Invention

This invention relates to a correspondence kit and method for repeatedly sending correspondence between two or more participants. The correspondence kit includes a journal, mailing envelopes and accessories for two or more persons to repeatedly circulate the journal for the continued exchange of correspondence.

2. Description of the Related Art

It is often desirable to receive a response to correspondence. In U.S. Pat. No. 5,219,184 to Wolf, a gift card is described having a portion which can be removed and returned to the sender as an expression of gratitude for a gift and/or the card. The purpose and use of the invention, as disclosed and claimed, is for a single exchange of correspondence between two people, for a limited, or special occasion. A similar invention is described in U.S. Pat. No. 867,613 to Scragg.

A two way envelope and letter is described in U.S. Pat. No. 3,863,836 to Austin. In U.S. Pat. No. 4,044,942 to Sherwood, a mailing folder for returning document is described. These two patents encompass mailing items which provide a convenient instrument for the receiver of correspondence to return correspondence to the sender, using the same envelope or folder. They do not disclose inventions for repeatedly sending correspondence back and forth between a sender and a receiver.

A reusable greeting card is disclosed in U.S. Pat. No. 4,613,157 to Drabish. The card is a typical single-folded sheet of material having a greeting on the upper portion and removable signature lines at or near the bottom. The sender signs the card at the lowest signature line and sends it to a receiver. The receiver can remove the signature from the card and use the card again. Multiple removable signature lines facilitate recycling of the card among multiple senders and receivers. As the card is intended to be reused multiple times, the integrity of the card is ruined if a sender writes anywhere but adjacent one of the removable signature lines. The purpose of the card is to allow evidence of prior correspondence to be removed so it can be reused.

Another multiple-use greeting card is described in U.S. Pat. No. 3,894,755 to Cieslak et al. That invention does not have removable portions for the sender's signature, but is provided with a number of signature and date lines. The card can be sent back and forth between a sender and a receiver, with the card being signed and dated each time. This provides an on-going record of the sender on a given date or occasion. The card may also be sent to third persons who will be able to ascertain the prior travels of the card between prior recipients.

SUMMARY OF THE INVENTION

The instant invention is a correspondence kit which includes a book or journal having numerous blank pages, multiple envelopes for mailing the book between two or more parties, and accessories which allow the users to customize the book, such as photograph corners, stickers and labels. The kit is intended to facilitate ongoing communication between two or more people.

A method for utilizing the correspondence kit includes the first participant writing in the book, adding photographs, drawings, mementos or virtually anything that can be fastened to a page in the book, and mailing the book, mailing envelopes and book accessories to another participant (i.e., a second or further participant). The recipient can enjoy the sender's message, information and enclosures, then enter his or her own message, information and enclosures, and return the book to the sender, or pass it along to another participant, in one of the provided envelopes. A written and visual correspondence between the two or more persons will continue as the book is repeatedly sent among the participants over a period of time.

Entries in the book, and any enclosures provided by the participants, such as photographs, become part of the permanent correspondence record between the participants.

DETAILED DESCRIPTION OF THE INVENTION

Figure 1:
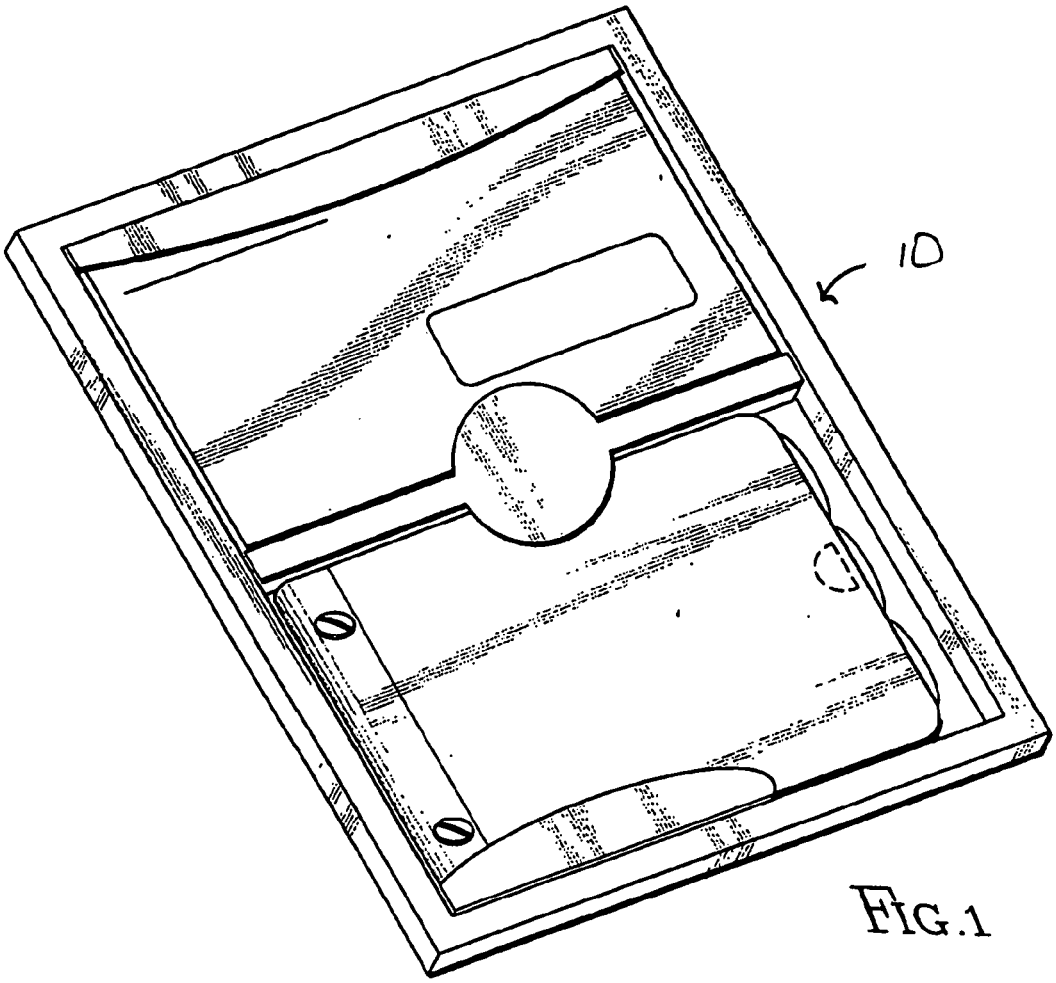
FIG. 1 is a perspective view of an exemplary embodiment of the correspondence kit of the present invention.
Figure 2:
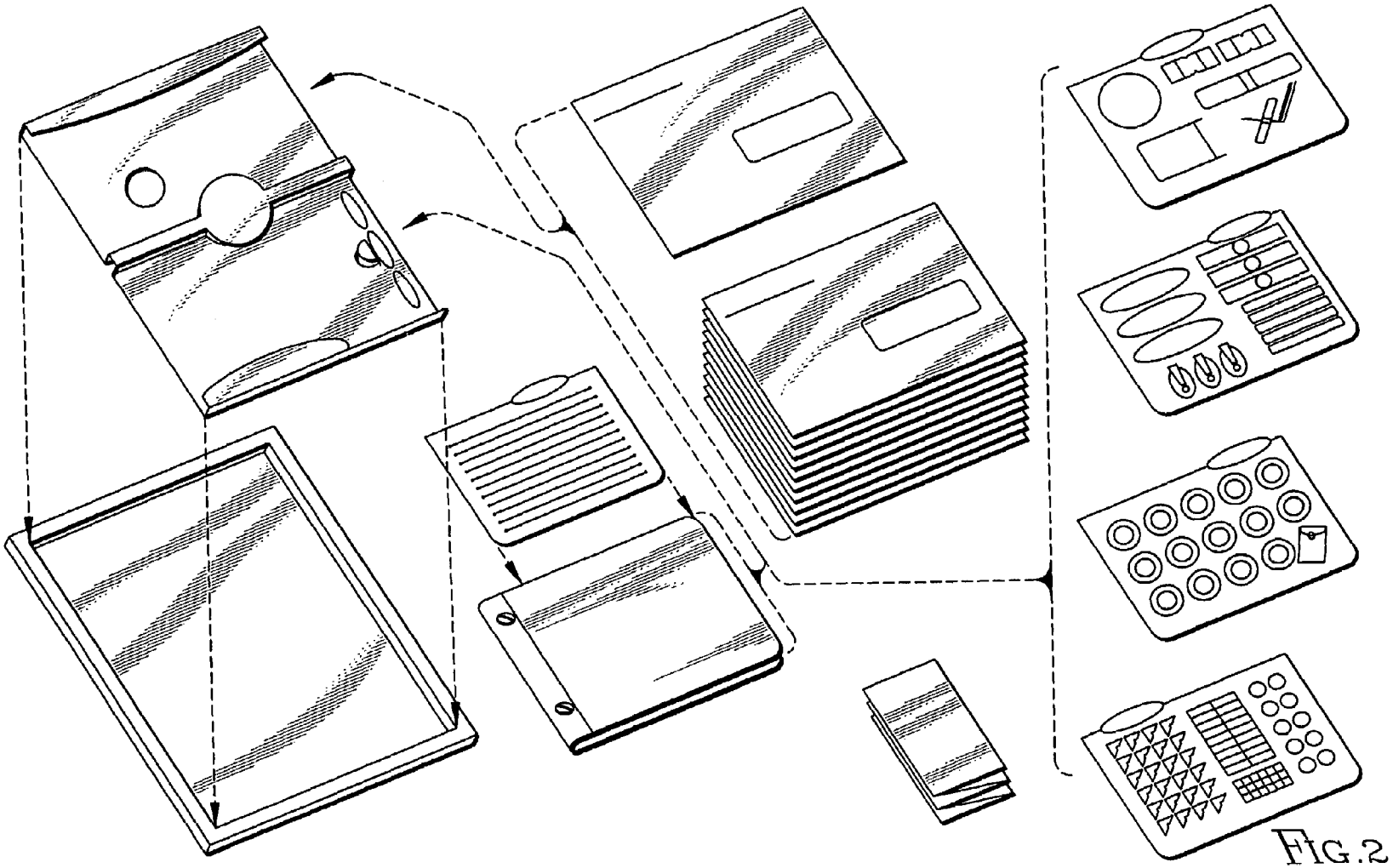
FIG. 2 is an exploded view of the individual elements of the correspondence kit of FIG. 1.
Figure 3:
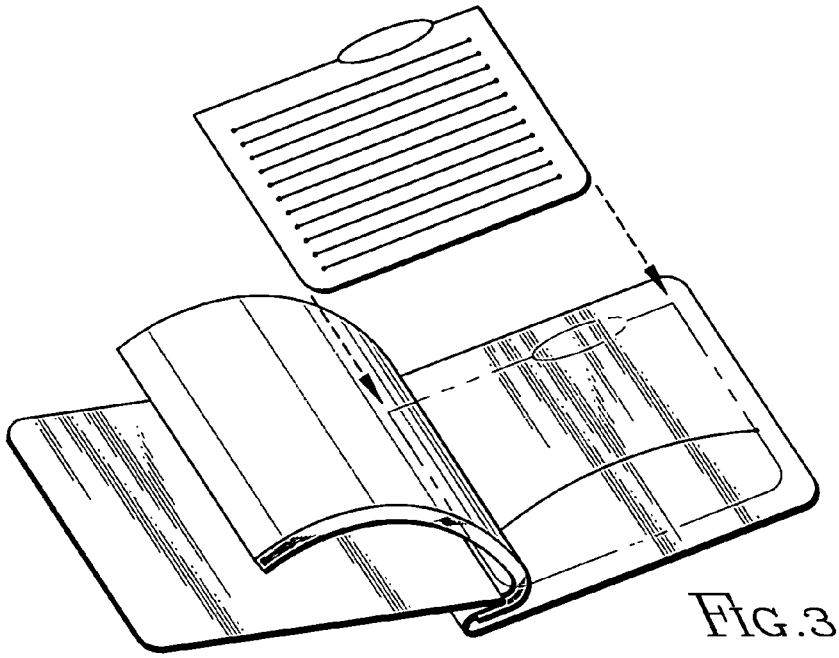
FIG. 3 is an exploded view of the line guide and back pocket of the correspondence kit.
Figure 4:
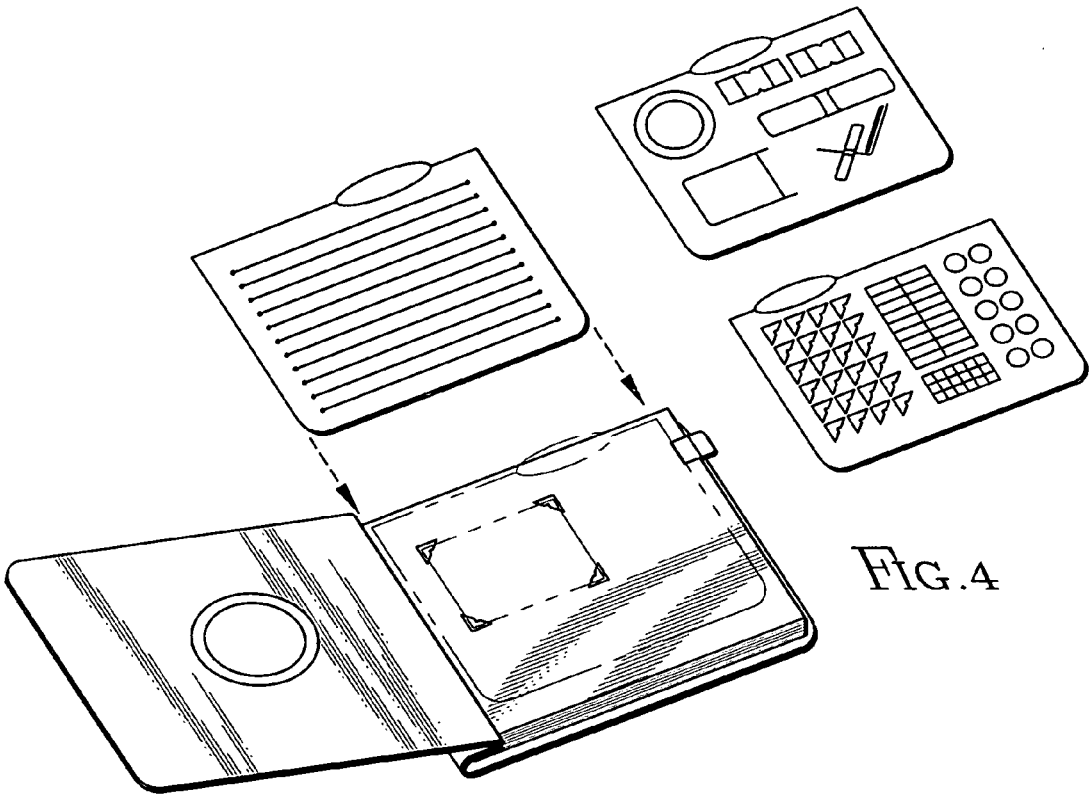
FIG. 4 is a view of the correspondence ki in use.
Figure 5:
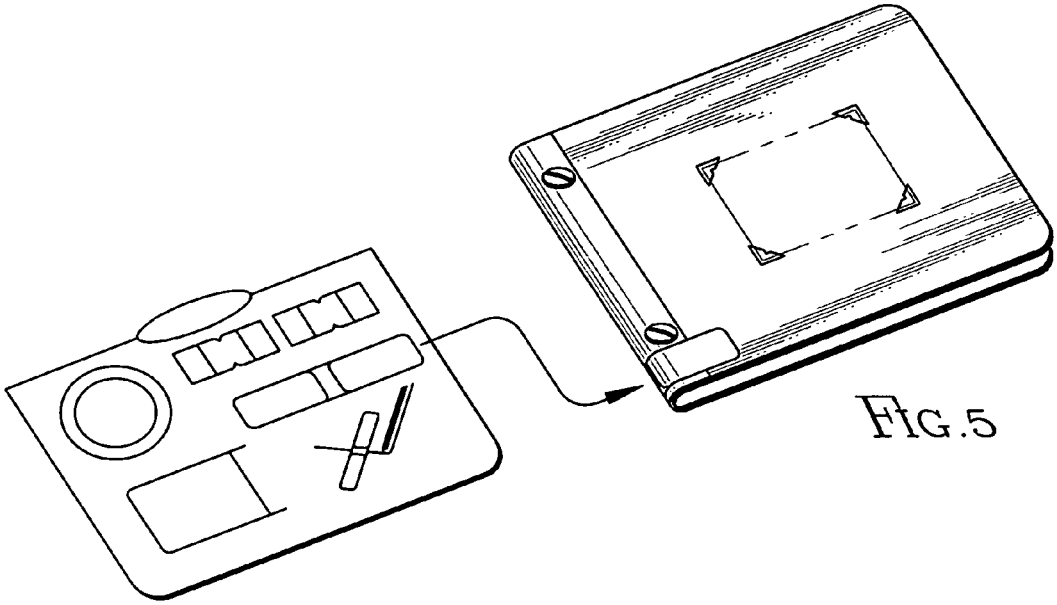
FIG. 5 is a view of the correspondence kit in use.

An exemplary embodiment of a packaged correspondence kit in accordance with the present invention is shown in FIG. 1 at 10. The correspondence kit includes a journal having multiple writing pages (e.g., a bound blank book), multiple mailing envelopes and a primary mailing envelope. In the preferred embodiment, the pages of the journal will be unlined to facilitate creativity of the participants. The kit further includes ornamentation decals, as shown in FIG. 2. The participants can paste mementos, add photographs or draw in the journal. If a participant desires a neat appearance of writing, a line guide is provided having a plurality of spaced-apart lines, the use of which is shown in FIG. 5. The participant can use the lined guide to control their writing and to encourage a neat appearance in the journal. The line guide may be stored in the journal back pocket shown in FIG. 3.

A first participant creates at least one page in the journal. For example, the first participant writes a letter to the desired correspondent, possibly adding mementos, photographs, or other memorabilia or ornamentation. The first participant will mail the journal and half the mailing envelopes to a second participant in a large primary mailing or sending envelope. A second participant receives the journal and envelopes via regular United States Mail, or other exchange or shipment methods. The second participant can review the entry of the first participant and then enter their own thoughts, ideas, mementos, drawings and photographs in the journal. Using one of the envelopes provided, the second participant returns the journal to the first participant, or sends it to another participant, who repeats the process of entering information into the journal and sending it to the next participant. The ongoing exchange process is repeated by the participants until the journal is completed.

The correspondence kit will contain a predetermined number of mailing envelopes to allow the participants to send the journal back and forth several times. A plurality of consecutively numbered adhesive labels will be provided for marking the envelope to designate the number of exchanges of the journal between a first recipient and a second recipient.

Figure 6:
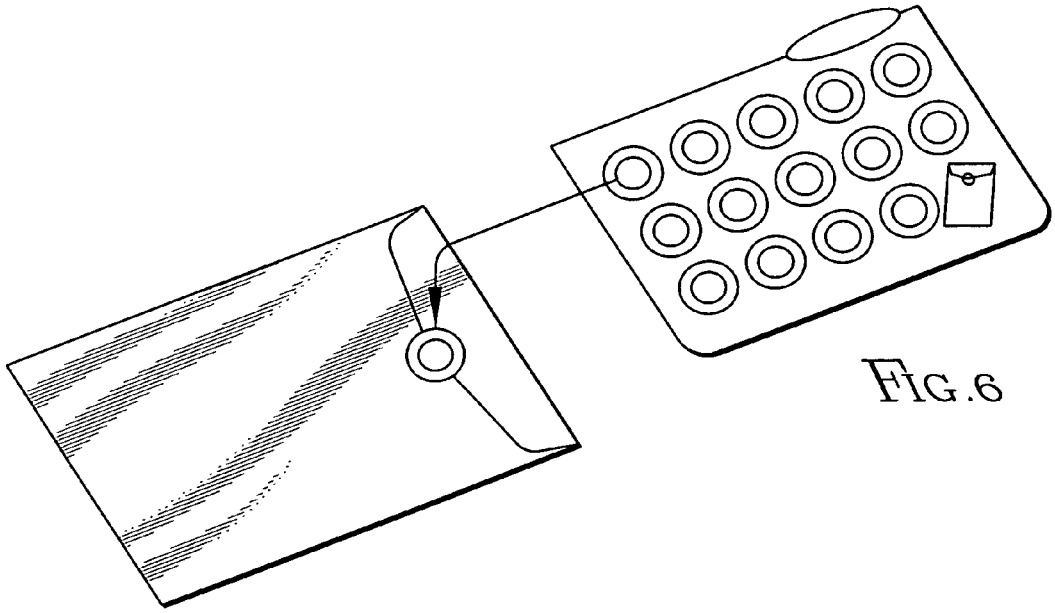
FIG. 6 is another view of the correspondence kit in use.

In an exemplary embodiment, each blank book has 30 fold-over sheets, resulting in 60 writing sheets per book, such that a reasonable number of writings, photographs, etc., may be placed in the journal by the participants before the journal is completed. The packaged correspondence kit will contain adhesive photograph corners for fastening photographs, or other similarly shaped items, to the pages of the journal. Also included will be pre-marked adhesive mailing labels for designating the package as air-mail, special shipping, as a fragile item, or with any other mailing indicia. Blank labels will be included so that the participants can customize mailing labels, or simply for use in personalizing the journal. Additionally, as shown in FIG. 5, an adhesive label can be placed on the spine of the journal such that the starting and ending date of journal use can be documented thereon. FIG. 6 shows how adhesive labels, such as envelope seals, may be placed on the mailing envelope. Further, the back pocket shown in FIG. 3 may be used to store the mailing labels and other adhesive labels in addition to the lined guide, and a hidden pocket may also be provided for additional storage of various items.

Whereas the present invention has been described in relation to the drawings attached hereto, it should be understood that other and further configurations, including multiple themes and designs, apart from those shown or suggested herein, may be made within the spirit and scope of this invention.

What is claimed is:

1. A method for exchanging correspondence between two or more persons, comprising the steps of:

providing a journal having multiple pages, a purality of mailing envelopes sized and configured to receive the journal, and at least one primary mailing envelope sized and configured to receive both the journal and a portion of the plurality of mailing envelopes;

a first person adding correspondence to the journal, the correspondence being selected from the group consisting of writings, photographs, momentos, stickers, memorabilia, and ornamentation;

the first person mailing the journal and a plurality of the mailing envelopes in the primary envelope to a second person after the first person has added the correspondence to the journal;

the second person receiving the journal;

the second person adding additional correspondence to the journal, the additional correspondence being selected from the group consisting of writings, photographs, mementos, stickers, memorabilia, and ornamentation;

the second person mailing the journal in one of the received mailing envelopes to a participant selected from the group consisting of the first person and another person after the second person has added the additional correspondence to the journal;

repeating adding correspondence to the journal and mailing the journal until the journal pages have been filled with correspondence;

providing a plurality of consecutively numbered adhesive labels for marking the number of times the journal has been mailed;

maintaining the plurality of consecutively numbered adhesive labels with the journal;

placing the consecutively numbered adhesive label that corresponds to the number of times the journal has been mailed on the journal before each respective mailing of the journal.

2. A method for exchanging correspondence between two or more persons, comprising the steps of:

providing a journal having multiple pages, a plurality of mailing envelopes sized and configured to receive the journal, and at least one primary mailing envelope sized and configured to receive both the journal and a portion of the plurality of mailing envelopes;

a first person adding correspondence to the journal, the correspondence being selected from the group consisting of writings, photographs, momentos, stickers, memorabilia, and ornamentation;

the first person mailing the journal and a plurality of the mailing envelopes in the primary envelope to a second person after the first person has added the correspondence to the journal;

the second person receiving the journal;

the second person adding additional correspondence to the journal, the additional correspondence being selected from the group consisting of writings, photographs, momentos, stickers, memorabilia, and ornamentation;

the second person mailing the journal in one of the received mailing envelopes to a participant selected from the group consisting of the first person and another person after the second person has added the additional correspondence to the journal;

repeating adding correspondence to the journal and mailing the journal until the journal pages have been filled with correspondence; and keeping the journal after the journal pages have been filled with correspondence for maintaining a record of the correspondence.

* * * * *